United States Patent [19]

Noda

[11] Patent Number: 4,910,554

[45] Date of Patent: Mar. 20, 1990

[54] COPYING APPARATUS PROVIDED WITH AN AUTOMATIC LIGHT EXPOSURE CONTROL SYSTEM

[75] Inventor: Yoshiyuki Noda, Kyoto, Japan

[73] Assignee: Sharp Kabushiki Kaisha, Osaka, Japan

[21] Appl. No.: 173,623

[22] Filed: Mar. 25, 1988

[30] Foreign Application Priority Data

Mar. 31, 1987 [JP] Japan ..... 62-79250

[51] Int. Cl.[4] ..... G03G 21/00; G03G 15/04; G03B 27/72

[52] U.S. Cl. ..... 355/208; 355/69; 355/214

[58] Field of Search ..... 355/14 E, 69, 206, 208, 355/214

[56] References Cited

U.S. PATENT DOCUMENTS 4,136,277 1/1979 Gerrard ..... 355/68 X
4,354,758 10/1982 Futaki ..... 355/14 E
4,699,502 10/1987 Araki et al. ..... 355/14 E
4,714,945 12/1987 Fujiwara et al. ..... 355/14 E X
4,755,852 7/1988 Fujita ..... 355/14 E

FOREIGN PATENT DOCUMENTS 58-23066 2/1983 Japan .
60-10267 1/1985 Japan .
1559021 1/1980 United Kingdom .

*Primary Examiner*—Fred L. Braun

[57] ABSTRACT

A copying apparatus is provided with an automatic light exposure control system for setting the amount of light from a light source on the basis of light reflected by an original document to which light from the light source is applied, the amount of light in a plurality of levels is applied to a reference document so that data of light reflected from the reference document may be stored in the apparatus. When a certain document is copied, the amount of light from the light source is automatically controlled on the basis of the data of reflected light of the document to be copied and the data of reflected light of the reference document stored in the apparatus.

3 Claims, 5 Drawing Sheets

| COUNTER | B | RATIO |
|---|---|---|
| C | Vr | G |
| 1 | Vr1 | G1 |
| 2 | Vr2 | G2 |
| 3 | Vr3 | G3 |
| 4 | Vr4 | G4 |

COPYING APPARATUS PROVIDED WITH AN AUTOMATIC LIGHT EXPOSURE CONTROL SYSTEM

BACKGROUND OF THE INVENTION

1. Field of the Invention

The present invention generally relates to a copying apparatus provided with an automatic light exposure control system for controlling exposure of a light source adapted to apply light to an original document to be copied, and more particularly, to the improvement of the automatic light exposure control system.

2. Description of the Prior Art

In the conventional copying apparatus, the density of an original document is detected for the purpose of obtaining light exposure corresponding thereto. To this end, the conventional copying apparatus generally has an automatic exposure control function for automatically controlling the amount of light applied to the document so that the copying operation may be executed with proper light exposure.

This kind of copying apparatus is provided with a light exposure setting means for setting constant the relationship between the light exposure to be applied to a photoreceptor or photosensitive member and an output of a document density detecting means for detecting the density of the document. Accordingly, proper exposure is automatically applied to each document.

However, in the conventional copying apparatus having the above described automatic exposure control function, an output from a light receiving sensor varies according to the copying apparatus accommodating the senor. This is caused by the characteristic of the sensor, and the position of the sensor in each copying apparatus or the like, even though the amount of light emitted from the light source is rendered to be constant. Accordingly, in the case where the amount of light is automatically controlled, the output for controlling it varies according to the copying apparatus, thus resulting in that the image density of a half-tone document varies with the copying apparatus.

SUMMARY OF THE INVENTION

Accordingly, the present invention has been developed with a view to substantially eliminating the above described disadvantage inherent in the prior art copying apparatus, and has for its essential object to provide an improved copying apparatus in which sensitivity with respect to the exposure can be automatically controlled.

Another important object of the present invention is to provide a copying apparatus of the above described type which is simple in construction and stable in functioning, and can be readily manufactured at a low cost.

In accomplishing these and other objects, the copying apparatus of the present invention is provided with an automatic light exposure control system for setting the amount of light from a light source on the basis of light reflected by an original document to which the light from the light source is applied, and includes an exposure control means for applying the amount of light at a plurality of levels with respect to a reference original document and a storage means for storing therein data of reflected light corresponding to the application of the amount of light in a plurality of levels.

In the copying apparatus of the present invention, the amount of light from the light source is automatically controlled on the basis of the data of reflected light of a reference original document stored in the storage means and data of reflected light of the document to be copied.

By the above described construction of the present invention, not only the variation of an output of a light receiving sensor can be minimized on the basis of the data of reflected light at a plurality of levels with respect to a reference original document and the data of reflected light of the original document to be copied, but also the characteristics of the sensor can be standardized. As a result, the optimum amount of light can be automatically set without any difference among the copying apparatus.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
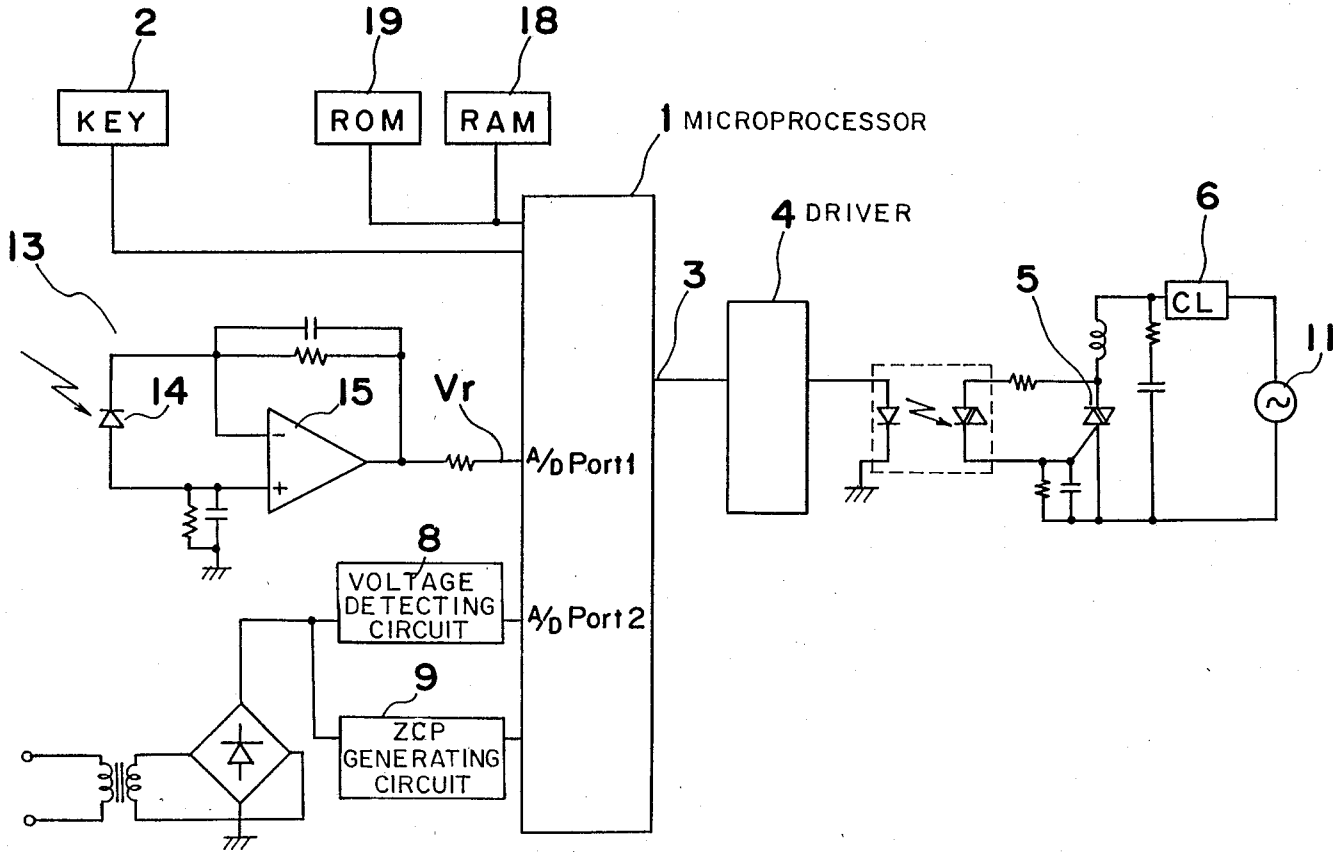
FIG. 1 is a circuit diagram of an exposure control circuit employed in a copying apparatus according to an embodiment of the present invention.

Referring first to the circuit diagram of FIG. 1, an operating portion 2 of a copying apparatus is connected to a microcomputer or microprocessor 1 which processes data in the unit of 8 bits. The operating portion 2 includes various kinds of key switches such as a print key, an exposure test key and the like, states of which are read by the microprocessor 1 in accordance with a control program previously written in a ROM 19. A RAM 18 is utilized as a working area for various flags, a counter or the like during the execution of the control program.

When a copy lamp 6 is turned on, the microprocessor 1 operates an ON phase of the copy lamp 6 on the basis of operation data of the operating portion 2, output data of a silicon blue cell 14, an alternating input voltage, a zero cross timing, an alternating frequency etc. and outputs a timing pulse every AC half-wave. The microprocessor 1 initially operates exposure data D and outputs the timing pulse on a phase corresponding to the exposure data D.

A driver 4 is connected with the microprocessor 1 to amplify the pulse outputted therefrom. When the output of an output port 3 is rendered to be "H", a triac 5 is turned on so that a phase control voltage may be applied to the copy lamp 6.

The microprocessor 1 is also connected to a voltage detecting circuit 8 for detecting the voltage proportional to an AC input voltage 11 and to a zero cross pulse (ZCP) generating circuit 9 for detecting the timing when the AC input voltage has become 0 V.

Furthermore, the microprocessor 1 has a function for compensating voltage fluctuation of the AC power source 11. Accordingly, a firing angle of the triac 5 is controlled so that no voltage fluctuation takes place between both terminals of the copy lamp 6, even if the AC power source 11 fluctuates. Thus, a predetermined light exposure i.e., the predetermined amount of light for exposure can be kept substantially constant at all times.

A document density detecting circuit 13 includes a silicon blue cell 14 as a photo sensor for detecting an amount of light reflected by the document to output a voltage proportional to an amount of light received thereby. The output of the silicon blue cell 14 is amplified through an operational amplifier 15 to be inputted as document density data Vr into an A/D converter (not shown) accommodated in the microprocessor 1. The microprocessor 1 rectifies the exposure data D in accordance with the document density data Vr to newly output a phase control pulse corresponding thereto so that the copy lamp 6 may be automatically rectified in illuminance. When the document density is bright, the value Vr becomes larger and the light exposure is reduced. In contrast, when the document density is dark, the light exposure is increased. In this way, the exposure control is automatically controlled.

Figure 2:
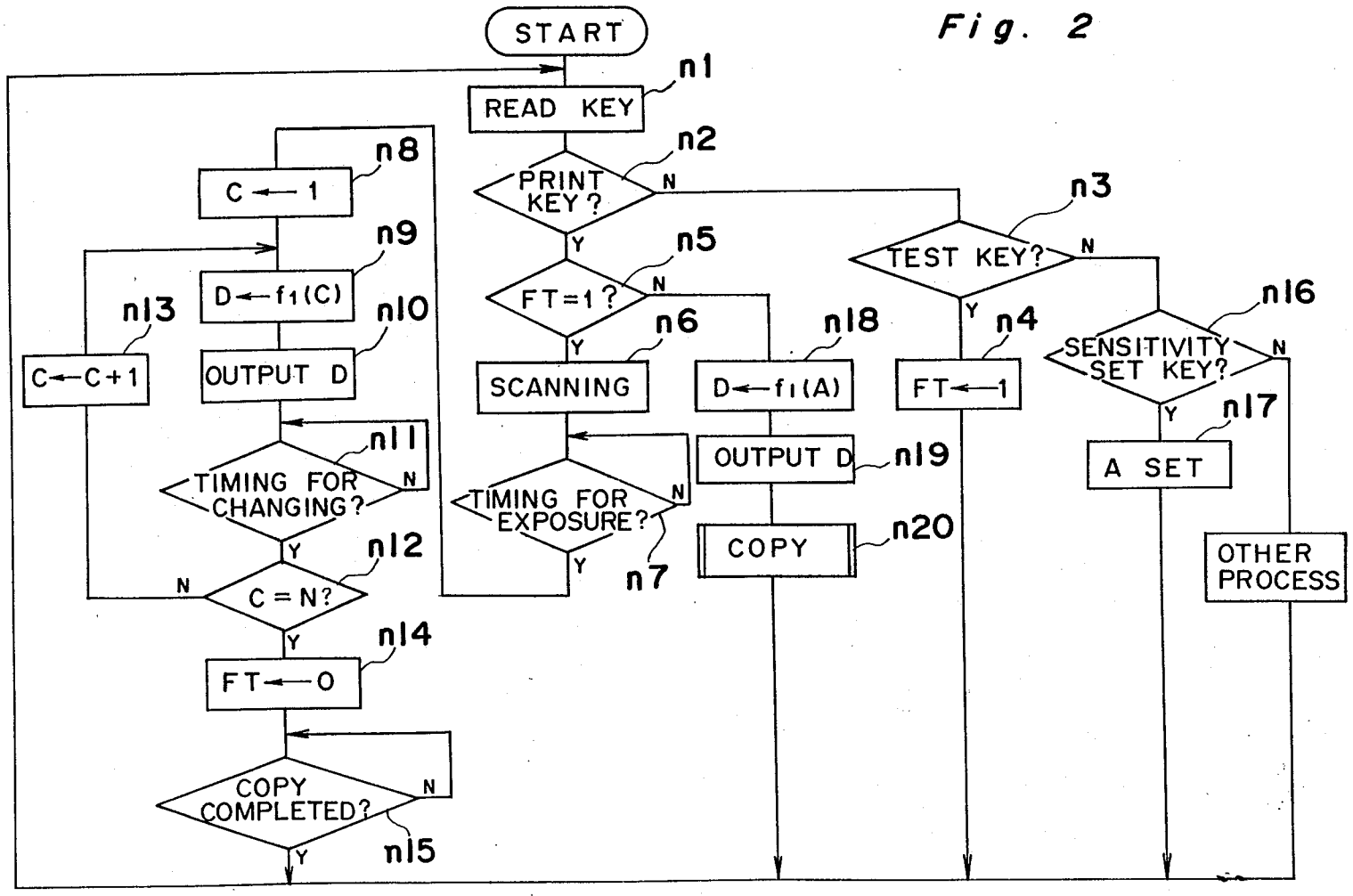
FIG. 2 is a flow-chart showing the procedure of a program to be executed by a microprocessor provided in the copying apparatus of the present invention.

FIG. 2 illustrates a flow-chart showing the program to be executed by the microprocessor 1.

The states of various keys provided in the operating portion 2 are initially read at step n1 followed by step n2 at which it is judged whether or not the operated key is the print key. If the operated key is not the print key, it is judged at step n3 whether or not the operated key is the test key. If the operated key is the test key, a flag FT is set to 1 at step n4 and the procedure returns to step n1. Thereafter, when the print key has been operated, it is judged at step n5 that the flag FT has been set and is equal to 1. The document scanning is then initiated at step n6 followed by step n7 at which it is judged whether or not the timing suitable for starting the exposure has come. If the judgment at step n7 is YES, the counter C is set to an initial value 1 at step n8. This counter C is used as a level memory for changing the light exposure in a plurality of levels. At step n9, the exposure data D is obtained on the basis of a fixed operation and the value stored in the counter C. The amount of light from the copy lamp 6 is determined at step n10 by outputting the phase control pulse corresponding o the exposure data D with respect to the driver 4. At step n11, it is judged whether or not the timing for changing the light exposure has come. If the judgment at step n11 is YES, it is judged at step n12 whether or not the value of the counter C has reached a predetermined one N. If the counter C is not equal to N, 1 is added to the counter C at step n13 so that the light exposure may be changed and, the procedure repeats steps n9 to n13, until the counter C becomes equal to N at step n12. Thus a photoreceptor or photosensitive member is exposed to light by the light exposure in a plurality of different levels. Upon completion of all exposure, the flag FT is reset at step n14 and the copying operation is executed at step n15. At this step for executing the copying operation, an image formed on a certain document may be actually transferred onto a transfer sheet or the like, or the paper sheet may not be necessarily used.

The light exposure may be changed without executing the exposure by the scanning on condition that an optical system is kept to a halt, if the photoreceptor is not subjected to any undesirable influence such as fatigue when the copy lamp 6 has been turned on. In the case where the print key is activated in a normal copying mode, the copying operation is executed on the basis of the exposure value once set. More specifically, the exposure data D is obtained from the set value of the exposure at step n18 followed by step n19 at which the phase control pulse corresponding to this data is outputted into the driver 4 so that the amount of light of the copy lamp 6 may be controlled. Under these conditions, the normal copying operation is executed at step 20.

The above described process from step n6 to step n15 shows one example of preparatory process including a test mode in which the exposure is executed by successively changing the light exposure in a plurality of levels within a certain period of time. However, the test mode may not be necessarily provided and this kind of multistage process for changing the light exposure can be conducted in an area different from that for obtaining a copied image before or after one copying cycle.

Figure 3:
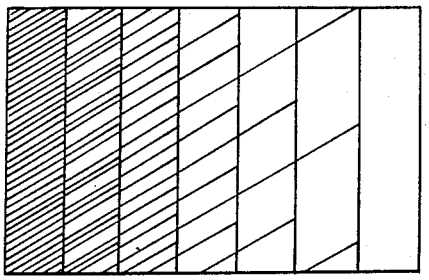
FIG. 3 is a view illustrative of states in which the light exposure changes step by step.

FIG. 3 illustrates the states in which the light exposure is successively changed step by step.

Figure 4:
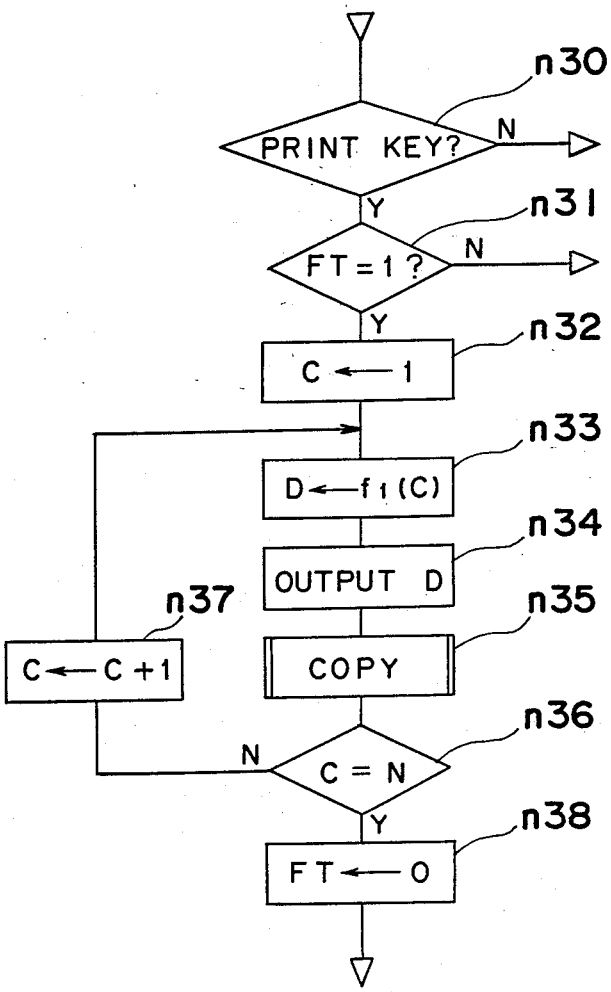
FIG. 4 is a flow-chart showing a part of the program procedure to be executed by the microprocessor in the case where a series of the process for changing the light exposure is executed before the copying operation.

FIG. 4 is a flow-chart showing a portion of the program carried out by the microprocessor 1 in the case where a series of processes for changing the light exposure is executed before the copying operation. This flow-chart indicates the process after the states of the keys have been read and corresponds to steps n6 to n15 in the flow-chart of FIG. 2.

Figures 5, 6:
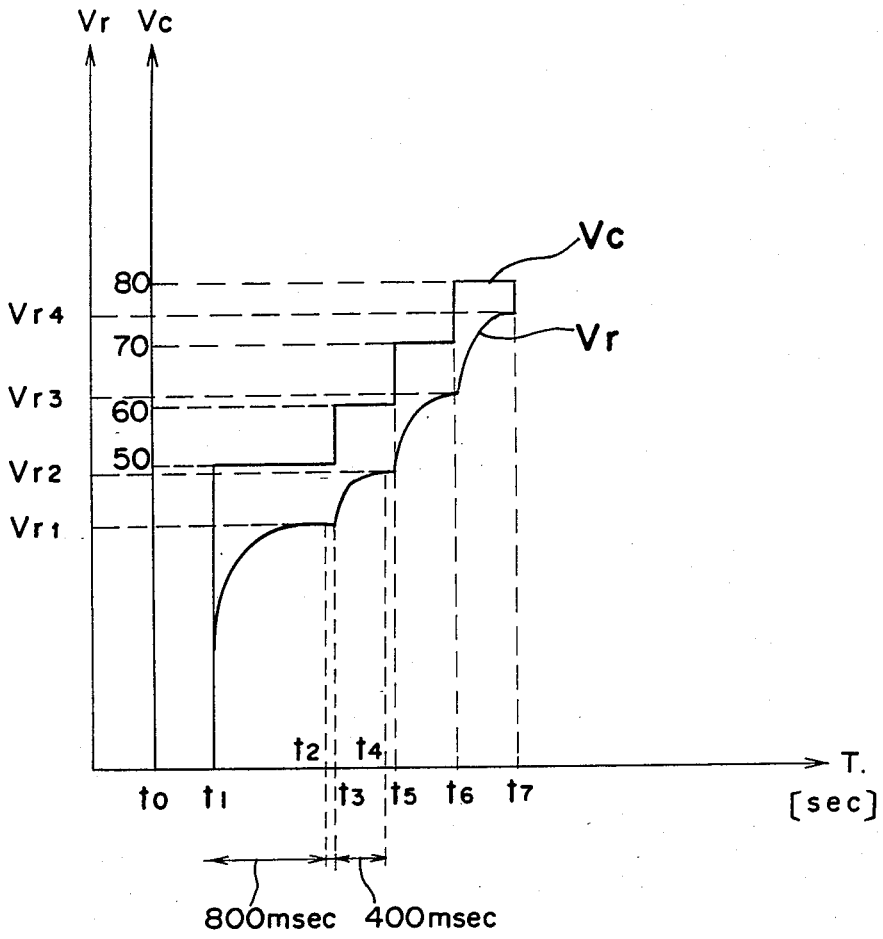
FIG. 5 is a graph showing a state in which output voltages in a plurality of levels are respectively applied to a copy lamp and a state of an output from a silicon blue cell.
FIG. 6 is a table, stored in a RAM, indicative of data of light reflected from a reference original document.

FIG. 5 shows the voltage Vc changing with time which is applied to the copy lamp 6 in the circuit of FIG. 1 and the reflected light Vr also changing with time which is obtained when a predetermined reference document has been exposed to the copy lamp 6. The voltage Vc of 50 V is initially applied to the copy lamp 6 and 10 V is then added to the voltage Vc so that 60 V may be applied thereto. In this way, the voltage Vc applied to the copy lamp 6 is increased step by step by each 10 V up to 80 V. The increment of the voltage Vc may be set to a smaller value than 10 V as occasion demands so that more levels of the voltage Vc may be applied to the copy lamp 6. Alternatively, the voltage Vc may be decreased step by step from its maximum value.

The voltage on each level is applied to the copy lamp 6 by turning on a gate of the triac 5 at a predetermined phase within a fixed period of time (approximately 800 to 400 msec), until the amount of light of the copy lamp 6 is stabilized. In this embodiment, the first period of time is set to 800 msec and other periods subsequent o the first one are each shortened to 400 msec. This period of time is properly set in accordance with an amount-of-change of the setting voltage or may be set to a fixed value if it is satisfactorily long.

The light reflected by the reference document is read into the microprocessor 1 at an interruption timing of the zero cross pulse in the last four alternating half-waves upon stabilization of both the amount of light of the copy lamp 6 and the output from the silicon blue cell 14. An average value of the aforementioned four data is stored in the RAM 18.

FIG. 6 indicates the data of the reflected light of the reference document stored in the RAM 88 in such a manner.

Figure 7:
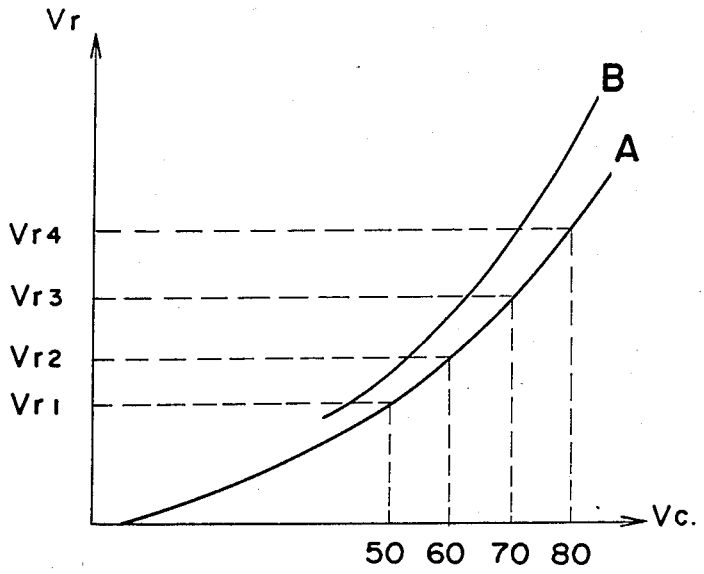
FIG. 7 is a graph showing the relationship between data A of reference reflected light stored in a ROM and data B of the reflected light newly inputted into the RAM.

FIG. 7 depicts the relationship between the voltage Vr of the reflected light from the document and a terminal voltage Vc of the copy lamp 6. A character A indicates reference data of the reflected light stored in the ROM 19 obtained on the basis of an average value of actual data of the reflected light with respect to the reference document. Another character B indicates data of the reflected light newly read into the RAM 18. Since the data B of the reflected light read into each copying apparatus differs from the reference data A, ratios G1 to G4 between the reference data A and the data B in respective sections to be measured are operated and stored with respect to respective voltages applied to the copy lamp 6.

The ratio G1 can be obtained by the following expression:

$$G1 = Vrb50/Vra50,$$

where

G1: the ratio of the reflected light when Vc is 50 V

Vrb50: an actual value of the reflected light with respect to the reference document when Vc is 50 V Vra50: the reference reflected light when Vc is 50 V (data stored in the ROM).

Subsequently, the ratio G2 is operated by adding each 10 V to the voltage applied to the copy lamp 6 up to 80 V.

Likewise, the operation for each measurement is carried out.

Figure 8:
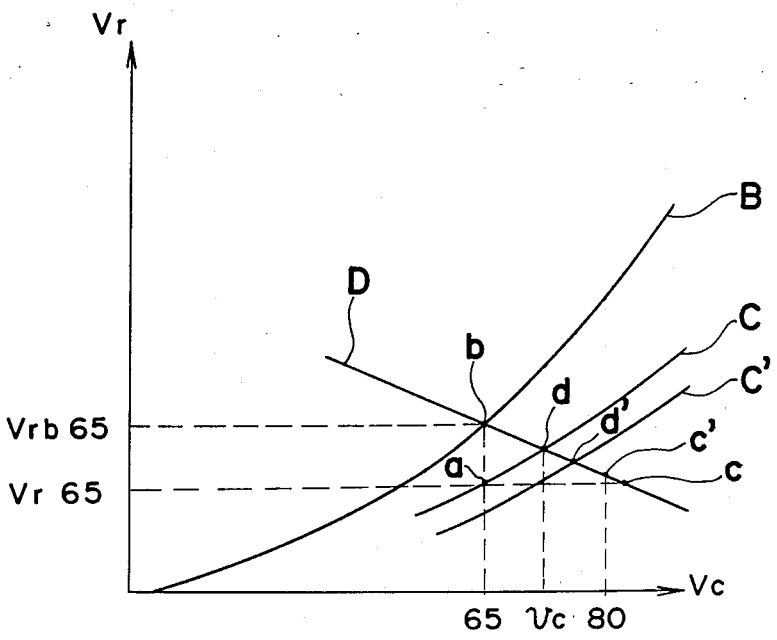
FIG. 8 is a graph indicative of the procedure towards the stabilization of the automatic exposure control.

FIG. 8 indicates the relationship among the data B of the reflected light when the reference document has been read into the apparatus of the above described type, the data C of the reflected light of the document to be actually copied and a transfer characteristic straight line D.

When a particular reference illuminance is set or the illuminance has been automatically set at a center of an exposure region, each of the curve B and the line D is individually determined in a particular apparatus. Accordingly, a stable point moves from (d) towards (d') in compliance with the change of the data of document density from C towards C'.

When a predetermined reference exposure voltage, for example, Vc=65 V is applied to the copy lamp 6, Vr65 is detected as the voltage of the reflected light. Since this value is less than the voltage Vrb65 of the reference reflected light, the transfer characteristic straight line having a negative slope is drawn at a point (b) corresponding to Vc65 on the characteristic curve B of the reflected light. In the microprocessor 1 is then operated the voltage applied to the copy lamp 6 (actually, a firing time from ZCP) corresponding to the point (c) crossing a horizontal line of Vr65. When the phase control voltage is applied to the copy lamp 6 on the basis of the aforementioned operation, the amount of light of the copy lamp 6 and the reflected light gradually increase. Because of this, an operating point in the control circuit moves towards the stable point (d) along a load characteristic straight line. In FIG. 7, in the case where the data read with respect to the reference document in the particular apparatus is greater than the reference data A (FIG. 7), the ratio G becomes greater than 1, rendering the slope of the transfer characteristic straight line of FIG. 8 to become greater than the reference value in proportional to the value G.

It is to be noted here that, in the above described embodiment, although the explanation has been made by selecting a single amplification factor (slope), the difference among the apparatus can be minimized by executing the control with the use of a plurality of amplification factors on the basis of data obtained in each measurement section.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included herein.

What is claimed is:

1. A copying apparatus comprising:

a light source for transmitting a defined amount of light onto an original document to be copied and an automatic light exposure control system for selectively setting the amount of said transmitted light from said light source on the basis of data of light reflected by said original document and data of light reflected from a reference document at a plurality of levels, said automatic light exposure control system including a RAM, means for detecting data in the amount of reflected light from a reference document to which light is applied at a plurality of levels, a storage means for storing said data of reflected light corresponding to said plurality of levels with respect to said reference document, said storage means consisting of a memory area provided in said RAM, and an exposure control means for regulating said defined amount of light from said light source at said plurality of levels relative to said reflected light from said reference document and light reflected from said original document;

whereby the amount of transmitted light from said light source is automatically controlled on the basis of said data of reflected light of the reference document stored in said storage means and said data of reflected light of said original document to be copied.

2. The copying apparatus as claimed in claim 1, further including a light exposure changing means for changing the light exposure in a plurality of levels.

3. The copying apparatus as claimed in claim 2, wherein said light exposure changing means is a counter.

* * * * *